US006120007A

United States Patent [19]

Grant

[11] Patent Number: 6,120,007

[45] Date of Patent: Sep. 19, 2000

[54] CARBURETOR WITH COLOR-CODED INTERCHANGEABLE COMPONENTS

[76] Inventor: Barry Grant, 206 Lanier Dr., Dahlonega, Ga. 30533

[21] Appl. No.: 09/047,072

[22] Filed: Mar. 24, 1998

Related U.S. Application Data

[63] Continuation-in-part of application No. 08/801,721, Feb. 14, 1997, Pat. No. 5,863,470.

[60] Provisional application No. 60/011,550, Feb. 13, 1996.

[51] Int. Cl.[7] ..... F02M 9/14; F02M 19/10

[52] U.S. Cl. ..... 261/23.2; 261/DIG. 12; 261/DIG. 56

[58] Field of Search ..... 261/23.2, 34.1, 261/78.1, DIG. 12, DIG. 39, DIG. 56

[56] References Cited

U.S. PATENT DOCUMENTS

| | | | |
|---|---|---|---|
| 4,235,828 | 11/1980 | Howes | 261/78.1 |
| 4,250,856 | 2/1981 | Abbey | 261/DIG. 56 |
| 4,375,438 | 3/1983 | McKay | 261/23.2 |
| 4,387,685 | 6/1983 | Abbey | 261/23.2 X |
| 4,808,007 | 2/1989 | King | 261/78.1 X |
| 4,966,735 | 10/1990 | LoRusso | 261/78.1 X |
| 5,591,383 | 1/1997 | Krup | 261/23.2 X |
| 5,667,730 | 9/1997 | Barfield | 261/23.2 X |
| 5,807,512 | 9/1998 | Grant | 261/23.2 |
| 5,809,972 | 9/1998 | Grant | 261/23.2 X |
| 5,863,470 | 1/1999 | Grant | 261/23.2 |

FOREIGN PATENT DOCUMENTS

| | | | |
|---|---|---|---|
| 1008052 | 5/1957 | Germany | 261/23.2 |
| 63-9665 | 1/1988 | Japan | 261/DIG. 12 |

*Primary Examiner*—Richard L. Chiesa

*Attorney, Agent, or Firm*—Thomas, Kayden, Horstemeyer & Risley

[57] ABSTRACT

Interchangeable venturi sleeves are removably positioned in open-ended bores of a carburetor center section. Each of the sleeves is colored a particular color corresponding to the physical parameters of the sleeve, for example, inner diameter and shape. Similarly, base plates and metering blocks of different capacities are provided such that the operating parameters of the carburetor can be changed. Like the venturi sleeves, the base plates and metering blocks are color-coded to indicate their physical parameters. With this color-coding, the observer can quickly and easily determine the physical characteristics of the carburetor.

16 Claims, 4 Drawing Sheets

CARBURETOR WITH COLOR-CODED INTERCHANGEABLE COMPONENTS

CROSS REFERENCE TO RELATED APPLICATIONS

This application is continuation-in-part of U.S. patent application Ser. No. 08/801,721 filed Feb. 14, 1997, now U.S. Pat. No. 5,863,470, which in turns claim the benefit of U.S. Provisional Application No. 60/011,550 filed Feb. 13, 1996.

FIELD OF THE INVENTION

This invention generally relates to fuel systems for internal combustion engines for high performance vehicles. More particularly, the invention relates to a carburetor having color-coded interchangeable or replaceable components, including interchangeable colored venturi sleeves and baseplates for adapting a carburetor to engines of different capacities. In addition, the invention pertains to interchangeable color-coded fuel metering blocks for adapting the carburetor for various quantities and types of fuels.

BACKGROUND OF THE INVENTION

Carburetors for high performance internal combustion engines are usually of high flow capacity. The carburetors as well as other components of such engines often need to be modified, however, when adjustment of vehicle performance is desired. For example, if the power capacity of the engine is altered or the carburetor is used with a different engine, the carburetor capacity must be modified to ensure maximum engine performance. Similarly, when the type of fuel used is changed, the carburetor must be modified to satisfy the particular requirements associated with the new fuel type.

Most modern carburetors are produced by one-piece casting. Accordingly, costly machining or total replacement is necessary where the user desires to increase carburetor capacity. In situations in which a decrease in capacity is needed, the user has no choice but to opt for total replacement of the carburetor. Therefore, it can be appreciated that it would be desirable to be able to adjust carburetor performance characteristics quickly and inexpensively.

In addition to altering the quantity of air supplied to the engine during the combustion cycle, the carburetor user may also wish to alter the type of fuel that is used for combustion. In such circumstances, alternatively sized fuel metering circuits are required. For instance, when switching from gasoline to alcohol fuel, approximately twice as much fuel by volume must be provided to the engine to attain comparable performance. Accordingly, it can be further appreciated that it would be desirable to be able to modify these fuel metering circuits to alter the amount of fuel that is supplied to the carburetor.

Where modifications, such as those described above, are effected, it would also be desirable to provide some means for identifying the physical parameters of the carburetor, such as throttle bore dimensions and applicable fuel type, to provide the carburetor user and/or servicer with a convenient and instantaneous indication of these parameters.

SUMMARY OF THE INVENTION

Briefly described, the present invention comprises a carburetor for an internal combustion engine, this carburetor having interchangeable or replaceable color-coded components including interchangeable venturi sleeves, carburetor base plates, and metering blocks. The interchangeable venturi sleeves are machined to have different sizes, shapes, and capacities, each size sleeve having its own associated color. The venturi sleeves are formed so as to seat in a predetermined position within its bore of the carburetor center section. A baseplate having openings therethrough attaches to the carburetor center section beneath the sleeves to hold them in their set positions. The dimensions of the baseplate depend upon the size of the particular venturi sleeves used. When correctly assembled, the diameter of the baseplate openings are substantially equal to the inner diameter of the base of the venturi sleeves. As with the venturi sleeves, each different baseplate configuration is identified by a particular color.

In addition to the venturi sleeves and the baseplate, the metering blocks of the carburetor are configured in different sizes depending upon the quantity of fuel to be supplied to the carburetor. Similar to the venturi sleeves and baseplates, each different size is designated with a different color.

In a preferred embodiment, each venturi sleeve includes an upper outer cylindrical surface sized and shaped to match the size and shape of the upper cylindrical portion of the bore of the carburetor center section and a lower outer cylindrical surface which is sized and shaped to match the lower cylindrical portion of the carburetor bore. In one aspect of the invention, an external annular shoulder joins the upper and lower outer cylindrical surfaces of the venturi sleeve with the shoulder of the venturi sleeve being sized and configured so as to abut a complementary shoulder formed in the bore of the carburetor center section. Configured in this manner, the venturi sleeve can be precisely positioned at the correct height in the carburetor center section.

Additionally, the lower outer cylindrical surface of the venturi sleeve has a flattened positioning cord formed thereon which is opposite to the side opening in the venturi sleeve. The positioning cord of one venturi sleeve engages against and is complimentary with respect to a similarly flattened positioning cord of an adjacent venturi sleeve, so that the positioning cords of venturi sleeves function to radially orient the venturi sleeves in the carburetor center section.

The bores of the center section intersect the bowl of the carburetor, so that the received venturi sleeves are in open communication with the carburetor bowl. The carburetor bowl is shaped to provide a smooth flow surface that surrounds each bore and venturi sleeve, to direct the air flow into the venturi throats. These surfaces are generally concave and slope downwardly along the carburetor bowl to intersect the bores of the carburetor center section, and therefore intersect the upper edges of the venturi sleeves. The fuel bowl surface therefore provides a smooth transition from the carburetor bowl into the throat of the venturi which minimizes the obstruction of air flow from the carburetor bowl to the venturi throat.

In a preferred configuration of the invention, each of the venturi sleeves, baseplate, and fuel metering blocks is colored a specific color that corresponds to a particular component parameter. Being color-coded in this manner, the observer can readily determine: (i) what size venturi sleeves are being used (and therefore the capacity of the carburetor), (ii) what size baseplate is being used, and (iii) how much fuel (and therefore the type of fuel) is being supplied to the carburetor. This color-coding system therefore obviates the need for the observer to measure the dimensions of these components while installed on the engine. Accordingly, the color-coding system can serve as a useful diagnostic tool with which the carburetor user can quickly and easily convey the particular carburetor configuration to a manufacturer or service technician when ordering parts or attempting to correct a performance problem.

Thus, it is an object of this invention to provide an improved carburetor for high performance internal combustion engines that has interchangeable components for altering carburetor performance.

Another object of this invention is to provide the various interchangeable carburetor components with different colors so the size and/or shape of the components can be readily determined with reference to a configuration correlation chart.

Other objects, features and advantages of the present invention will become apparent upon reading the following specification, when taken in conjunction with the accompanying drawings.

DETAILED DESCRIPTION

Figure 1:
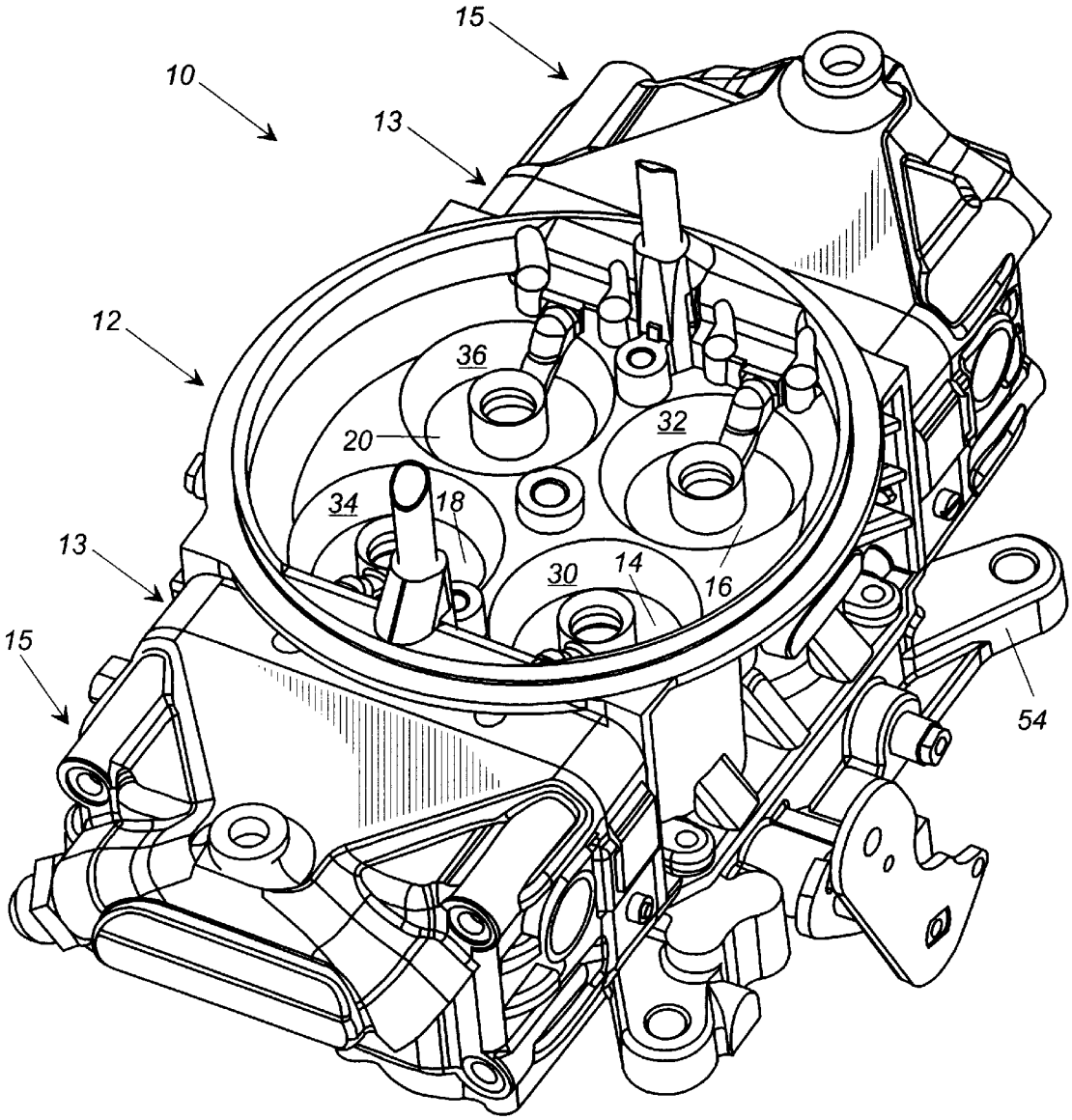
FIG. 1 is a perspective view of a carburetor of the present invention, with the venturi sleeves and booster venturis installed therein.
Figure 2:
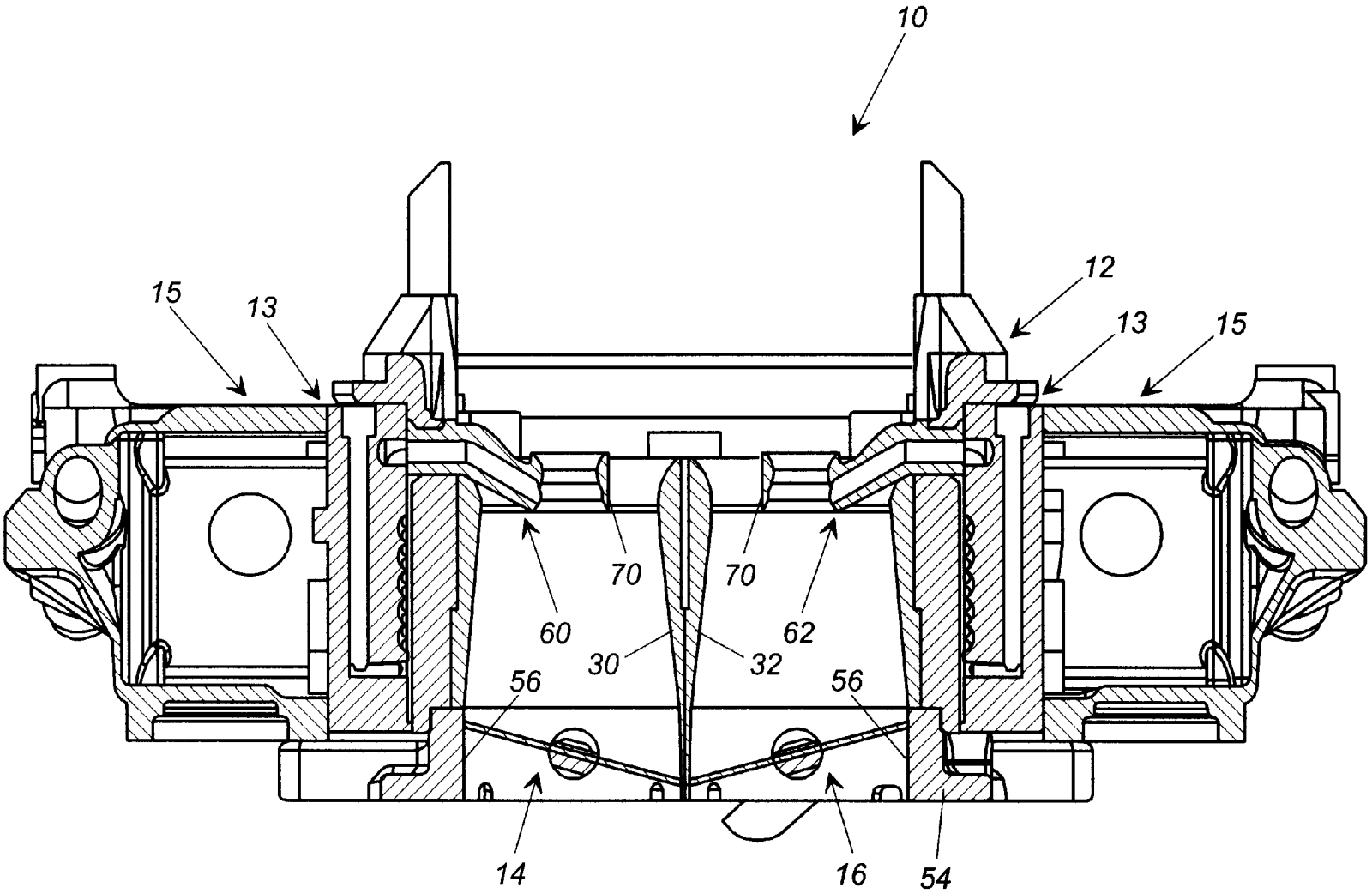
FIG. 2 is a side cross-sectional view of the carburetor center section with the venturi sleeves and booster venturis installed.
Figure 3:
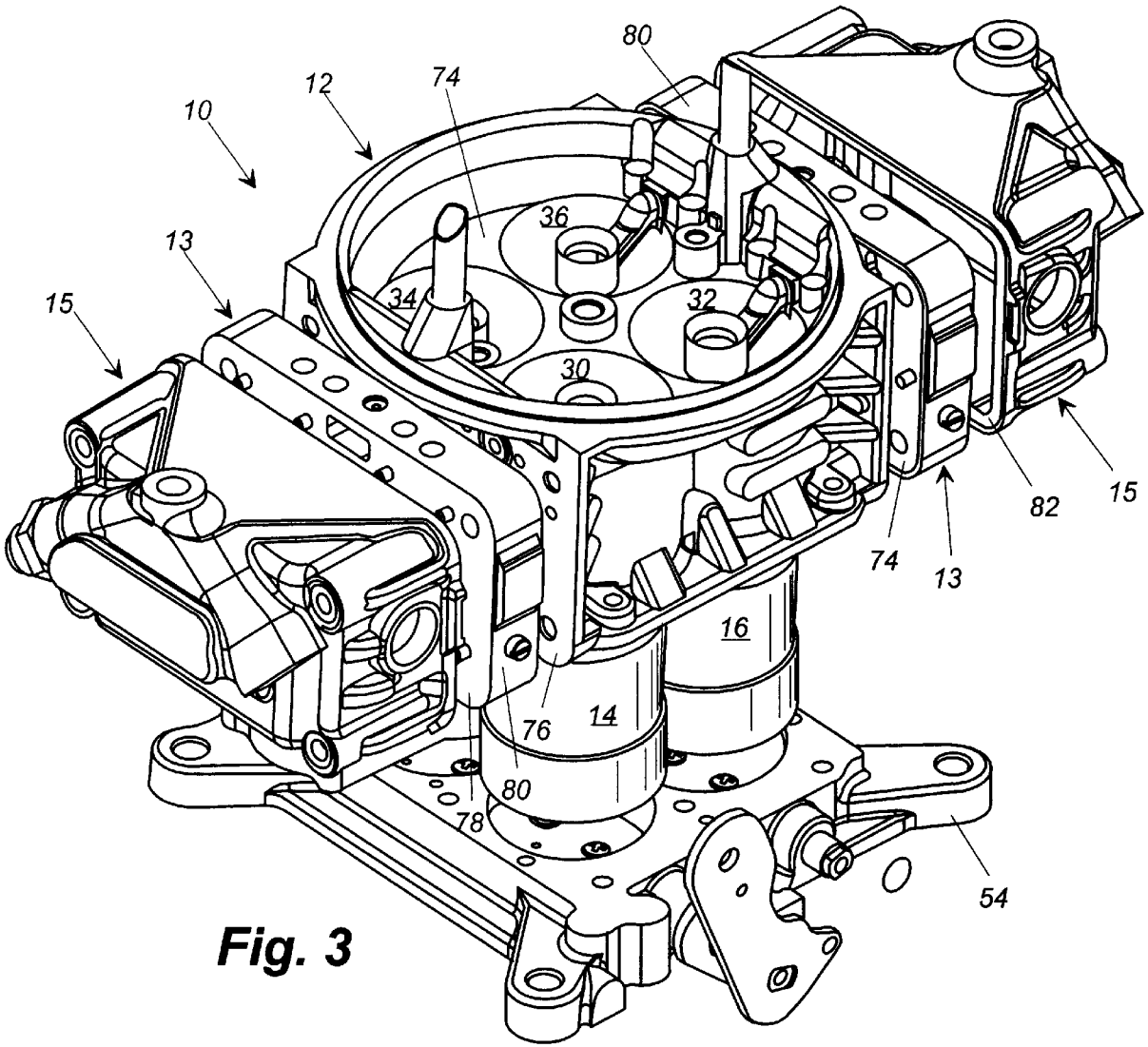
FIG. 3 is a perspective view of the carburetor of FIG. 1, shown with the venturi sleeves, base plate, metering blocks and fuel bowls displaced from the center section.

Referring now in more detail to the drawings, in which like numerals indicate like parts throughout the several views, FIGS. 1–3 illustrate the carburetor 10 which includes a cast carburetor center section 12, metering circuits or blocks 13, and float bowls 15. The carburetor center section 12 defines four open-ended bores 14, 16, 18, and 20 that are arranged in a rectangular cluster and which function to pass a mixture of fuel and atmospheric air or other gaseous medium to an internal combustion engine (not shown). The metering blocks 13 function to transport predetermined amounts of fuel supplied by the float bowls 15 to the center section after the fuel is first mixed with air or another gaseous medium. Accordingly, the metering blocks function as means for metering fuel to the carburetor. As is known in the art, the fuel metered to the carburetor, and thereby to the engine, can take the form of gasoline, alcohol, or other combustible liquid.

Figure 4:
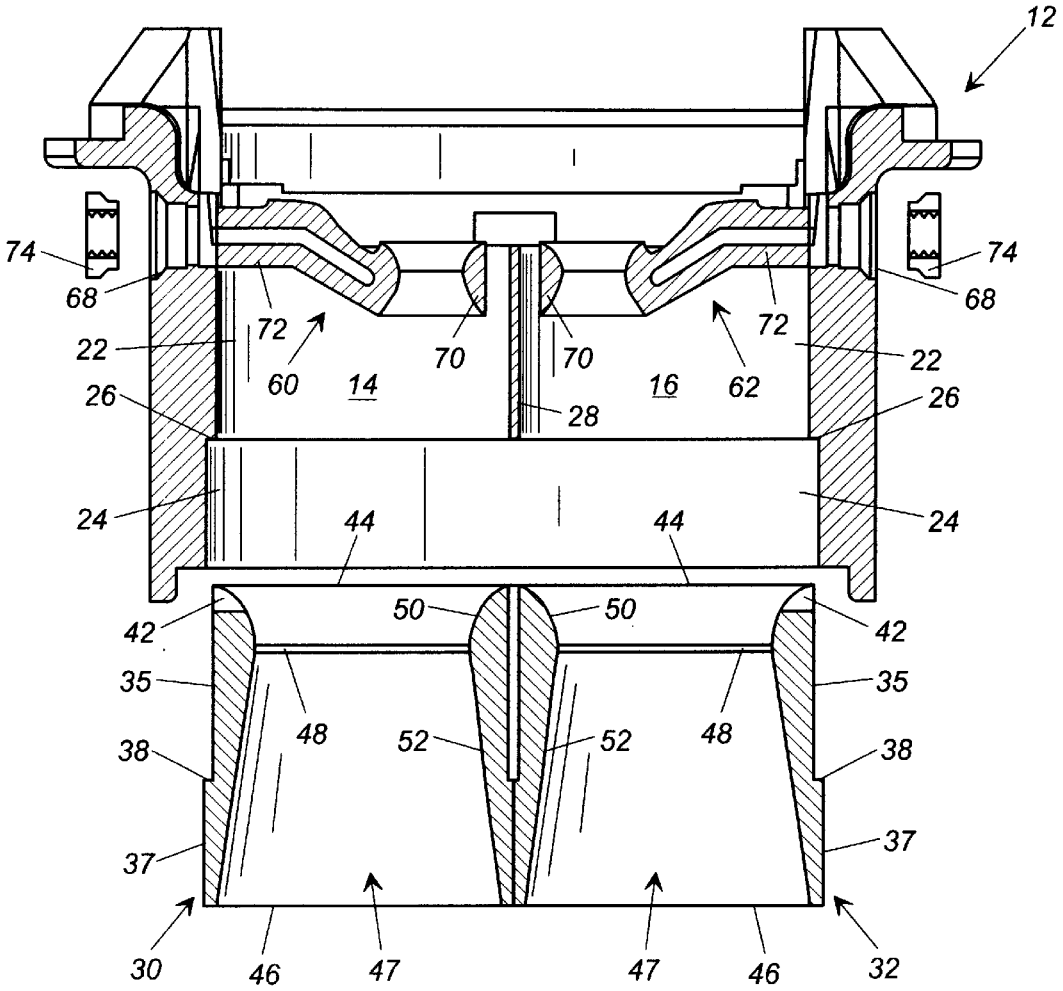
FIG. 4 is a side cross-sectional view of the carburetor center section with the venturi sleeves and the booster venturis displaced from their installed positions.

Illustrated in FIG. 4 is the center section 12, shown in cross-section. The bores 14, 16, 18, and 20, such as the bores 14 and 16 shown in FIG. 4, include an upper cylindrical portion 22, a lower cylindrical portion 24, and an annular shoulder 26 which joins the upper and lower cylindrical portions. When installed, the lower cylindrical portion 24 of bores 14 and 16 intersect lower cylindrical portions of bores 18 and 20 (not shown). A partition 28 separates the upper cylindrical portions of bores 14, 16, 18, and 20 from each other.

Machined venturi sleeves 30, 32, 34, and 36 are telescopically received in the bores 14, 16, 18, and 20, as shown in FIG. 2 with sleeves 30 and 32. Illustrated most clearly in FIGS. 4 and 5 with sleeves 30 and 32,the venturi sleeves each have an upper outer cylindrical surface 35 which is sized and shaped to match the size and shape of the upper cylindrical portion 22 of a bore, and a lower outer cylindrical surface 37 sized and shaped to match the size and shape of the lower cylindrical portion 24 of the bores. An external shoulder 38 is formed on the external surface of each venturi sleeve, with the external shoulder joining the upper and lower outer cylindrical surfaces of the venturi sleeve.

With the arrangement described above, the venturi sleeves 30, 32, 34, and 36 can be positioned within the bores 14, 16, 18, and 20,with the outer cylindrical surfaces 35 and 37 being telescopically received in the cylindrical portions 22 and 24 of the bores of the carburetor, until the external shoulder 38 of each venturi sleeve engages the internal shoulder 26 of its bore. This shoulder configuration fixes the longitudinal position of each venturi sleeve in its bore and therefore functions as a means for positioning the sleeves in the bores.

Figure 5:
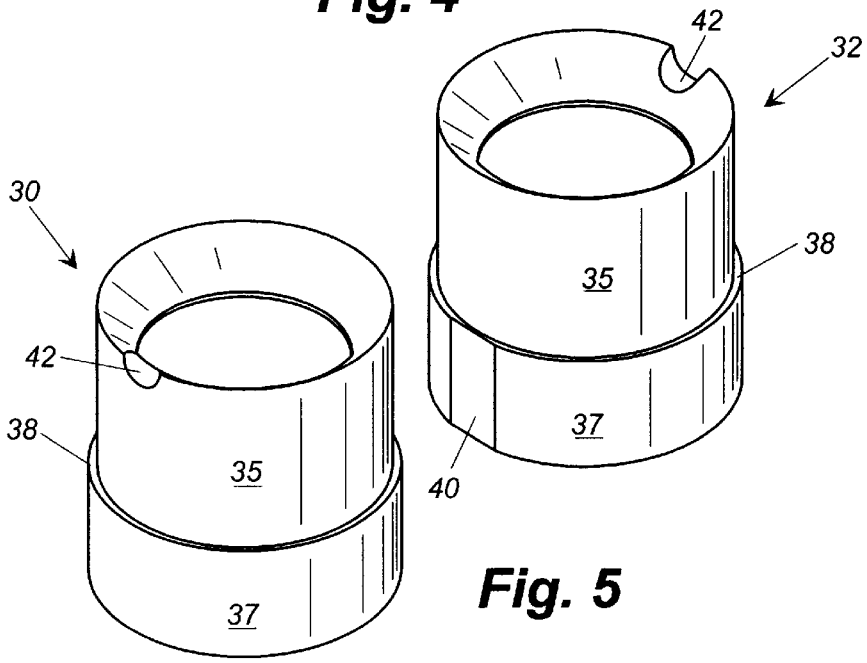
FIG. 5 is a perspective view of two venturi sleeves shown displaced from one another so as to illustrate a positioning cord of one of the sleeves.

As illustrated in FIG. 5 with sleeve 32, each venturi sleeve includes a positioning cord 40 which is formed in the lower outer cylindrical surface 36 of the venturi sleeve, this positioning cord extending the full length of lower outer cylindrical surface 36. Diagonally across from the positioning cord 40 is an opening in the shape of a slot 42 which is sized and shaped to receive the support conduit of a booster venturi, which will be described hereinafter. With this arrangement, the venturi sleeves such as sleeves 30 and 32, are placed closely adjacent one another so that the positioning cords 40 face each other and are moved into flat abutment with each other when the venturi sleeves are inserted in the bores of the carburetor center section 12 as shown in FIG. 2. When the positioning cords 40 of adjacent, side-by-side venturi sleeves are in abutment with one another, the venturi sleeves cannot be rotated about their longitudinal axes, and are locked into a nonrotatable position. Moreover, the slots 42 will be automatically aligned with the support conduits of the booster venturis upon their insertion into the center section.

As best illustrated in FIG. 4, each venturi sleeve 30, 32, 34, and 36 has a first or upper end 44, a second or lower end 46, and a venturi throat 47 having a venturi wall constriction 48. The constriction 48 is formed by a progressively converging annular inlet surface 50 and an annular tapered diverging exhaust surface 52 that forms the venturi throat. The venturi wall constriction 48, and therefore the venturi throat, functions to form a zone of low pressure when gas, such as air, moves along the longitudinal axis of each venturi sleeve to aspirate the fuel before it enters the engine.

A baseplate 54 (FIG. 2) is mounted to the bottom surface of the carburetor center section 12. The baseplate 54 includes openings 56 which are aligned with the venturi sleeves, so as to permit the free passage of air therethrough. When installed, the baseplate 54 engages the lower end 46 of each venturi sleeve in the carburetor center section, so that the venturi sleeves are trapped between the internal shoulder 26 of the bores 14, 16, 18, and 20 and the baseplate 54. Due to this engagement, the openings 56 of the baseplates must match the diameters of the lower ends of the venturi throats. Since the dimensions of the sleeves will vary depending upon what size sleeves are selected, the baseplates 54 are available with different sizes of openings 56.

Booster venturis 60, 62, 64, and 66 are each mounted to the carburetor center section 12 and are suspend within a venturi sleeve 30, 32, 34, and 36 respectively. As shown in FIG. 4, the carburetor center section 12 defines stepped openings 68 which extend from outside the carburetor center section inwardly through the side wall of the carburetor and intersect the inside of the carburetor immediately above the bores 14, 16, 18, and 20. The booster venturis such as the booster venturis 60 and 62 of FIGS. 2 and 3, each include a ring nozzle 70 and a support conduit 72. Each support conduit 72 has a distal end that protrudes into the opening 68 in the side wall of the carburetor center section 12, and internally threaded nuts 74 are threaded about the distal ends of the support conduits, from outside the carburetor center section to hold the booster venturis in place.

As best illustrated in FIGS. 1 and 3, the carburetor center section 12 defines a generally concave carburetor bowl 74 that faces the incoming air that flows through the carburetor. When the venturi sleeves 30, 32, 34, and 36 are telescopically inserted upwardly into the bores 14, 16, 18, and 20, the concave shape of the carburetor bowl directs the air entering the carburetor toward the venturi sleeves 30, 32, 34, and 36. In particular, the carburetor bowl is contoured to be substantially coextensive with the surface of the upper end 40 of the venturi sleeves. This coextensive relationship between the carburetor bowl 74 and the venturi sleeves functions to induce a smooth flow of air from the carburetor bowl into the venturi throats without requiring the air to negotiate angular surfaces or obstructions to, thereby, reduce turbulence in this portion of the carburetor and enhance the air flow efficiency of the carburetor. While concave flow surfaces have been described, it will be appreciated that other shapes can be used to enhance the flow of air from the carburetor bowl to the venturi throats such as fins, grooves, convex surfaces, ridges, flats, or vanes, or their equivalents, which are aligned in the carburetor bowl so as to smoothly direct the air movement toward the venturi throats.

As briefly identified above, the carburetor typically includes a pair of metering blocks 13 and a pair of float bowls 15 which attach to the respective metering blocks. As is known in the art, the float bowls 15 receive fuel which has been pumped from a fuel tank (not shown) and passed thorough a regulator to provide a local fuel source or reservoir of fuel for the carburetor. The proper level of fuel is maintained in the float bowl with a float and valve mechanism (not shown) of the type conventional in the art.

As shown in FIG. 3, each metering block 13 typically is formed as a substantially rectangular block having a carburetor mounting surface 74 adapted to abut opposed mounting surfaces 76 of the carburetor center section 12, a float bowl mounting surface 78 adapted to support the float bowl 15, and an outer periphery 80. Each float bowl 15 has a metering block mounting surface 82 adapted to mate with the float bowl mounting surfaces 80. When the carburetor is assembled, the outer periphery 80 of the metering block is plainly visible as illustrated in FIG. 1. Provided inside each metering block 13 is a plurality of inlet jets connected which connect to a series of circuits or passages (not shown) through which fuel travels during its transportation from the float bowls 15 to the carburetor center section 12. As is known in the art, air or another gaseous medium is mixed with the fuel as it passes through the passages to prepare it for atomization in the carburetor barrels. The flow characteristics of the metering block passages can be varied to suit the particular application in which the metering blocks are being used. In particular, the fuel output rate or metering rate required of the metering blocks will vary depending upon the type of fuel being used. For example, for a given engine, the amount of alcohol fuel to be supplied to the carburetor will typically be twice that supplied to the carburetor when gasoline is being used. Accordingly, separate gasoline metering blocks and alcohol metering blocks are available.

As can be appreciated from the above description, a plurality differently sized and/or configured interchangeable parts can be used with the carburetor. Since it is difficult to determine the particular physical parameters of these components without actually measuring each component, each interchangeable part is provided with a color that correlates to a particular physical parameter the component possesses. For example, each of the several different sizes of venturi throats is represented by a different color as indicated by Table I. In particular, these throat sizes pertain to the diameter of the wall constriction the throat possesses.

TABLE I

VENTURI SLEEVE COLORATION

| Color | Constriction Diameter | Throttle Bore |
|---|---|---|
| Green | 1.282 | 1.6875 |
| Red | 1.402 | 1.6875 |
| Blue | 1.425 | 1.750 |
| Gold | 1.500 | 1.750 |
| Black | 1.5625 | 1.750 |
| Silver | 1.590 | 1.6875 |

Since the baseplate selected must have openings which match the diameters of the lower ends, or throttle bores, of the venturi throats, alternative baseplate configurations are available. To distinguish between the particular configurations, each baseplate is provided with a color indicating its configuration. Example correlations are provided in Table II.

TABLE II

BASEPLATE COLORATION

| Color | Throttle Bore (in.) |
|---|---|
| Silver (Natural) | 1.6875 |
| Black | 1.750 |

Similarly, metering blocks having different output or metering rates are distinguished by coloration. Given that the particular rate of fuel metered to the carburetor is closely tied to the type of fuel being used, the coloration of the metering blocks will indicate for which type of fuel the metering block is intended to be used. Table III shows an example correlation.

TABLE III

FUEL METERING BLOCK COLORATION

| Color | Type of Metering Block |
|---|---|
| Black | Gasoline metering block |
| Gray | Alcohol metering block |

Accordingly, component coloration is used as means for indicating sleeve parameters including venturi size and shape, metering block parameters including metering rates, and baseplate parameters including opening dimensions. Although this coloration can be provided to each interchangeable part through any method which provides a bright and durable color, anodization is the preferred method of coloration.

Once colored, the particulars of each interchangeable part can be readily identified. In addition to simplifying internal handling of these parts, the color-coding greatly aids in diagnosing customer needs. With a cursory inspection of the carburetor, a customer can identify the venturi throat size, baseplate size, and metering rate of his or her carburetor. By providing a service technician or manufacturer with this information, the service technical or manufacturer can quickly determine the carburetor configuration the customer is using, whether each interchangeable part is appropriate for this particular configuration, and what other parts are suited for the customer's engine. In providing readily identifiable indicia of component parameters, the color-coding obviates the need for measurement or close inspection of each individual part.

While a preferred embodiment of the invention has been disclosed in detail in the foregoing description and drawings, it will be understood by those skilled in the art that variations and modifications thereof can be made without departing from the spirit and scope of the invention as set forth in the following claims. For instance, although particular shape and size characteristics have been described as being identified by color, it will be appreciated that other component characteristics similarly could be identified by these indications.

What is claimed is:

1. A carburetor for an internal combustion engine, comprising:

a carburetor center section defining a plurality of open-ended bores of substantially the same size and shape extending therethrough;

a plurality of sets of venturi sleeves for removably positioning in each of said bores, all of said sleeves of all of said sets having an external surface sized and shaped to match the size and shape of said bores of said center section and an internal venturi throat having an annular wall constriction provided thereon for generating a zone of low pressure at the constriction in response to a flow of air moving through said throat;

each sleeve of each set of sleeves having identically sized and shaped venturi throats, and the sleeves of different sets of sleeves having differently sized and shaped venturi throats, and the identically sized and shaped sleeves of each set of sleeves bearing the same color, and the sleeves of different sets of sleeves bearing different colors, each of said colors corresponding to the sizes and shapes of the venturi throats of said sleeves, wherein the color of each venturi sleeve identifies the size and shape of the venturi sleeve; and means for holding said venturi sleeves in said bores;

whereby when sleeves of the same color are positioned in the bores of a carburetor, all of the sleeves will have identically sized and shaped venturi throats.

2. The carburetor of claim 1, wherein said sleeves and said bores of said center section are formed with interenqaging surfaces which locate said sleeves longitudinally in said bores.

3. The carburetor of claim 1, wherein said venturi sleeves are anodized to provide said color.

4. The carburetor of claim 1, wherein said sleeves each include externally extending collars, and said bores of said center section include shoulders which engage said collars of said sleeves for longitudinally locating said sleeves in said bores.

5. The carburetor of claim 1, wherein said bores have upper portions and lower portions, with the lower portions of said bores having a larger breadth than the breadth of the upper portion of said bores, said sleeves having external upper and lower portions which match the sizes and shapes of said upper and lower portions of said bores, so that the sleeves nest in said bores.

6. A carburetor of claim 1, wherein said carburetor includes a baseplate, said base plate having a plurality of openings dimensioned to match the dimensions of a lower end of each venturi throat, and wherein said baseplate bears a color which identifies the base plate as having the dimensions of its openings corresponding to the dimensions of the lower ends of the venturi throats of said sleeves, whereby when a base plate and sleeves of corresponding colors are matched together the dimensions of the venturi throats of the sleeves and the dimensions of the openings of the base plate will match each other.

7. The carburetor of claim 6, wherein said baseplate is anodized to provide said color.

8. The carburetor of claim 1, further comprising pairs of fuel metering blocks for mounting to opposite sides of said center section and pairs of float bowls for mounting to said metering blocks, wherein said metering blocks are formed in predetermined sizes and shapes which correspond to the sizes and shapes of said sleeves, and the metering blocks of sizes and shapes which correspond to the sizes and shapes of said sleeves bear a color which corresponds to the color of said sleeves so that when metering blocks and sleeves of corresponding colors are assembled together they are of corresponding sizes and shapes.

9. The carburetor of claim 8, wherein said metering blocks are anodized to provide said color.

10. A carburetor for an internal combustion engine, comprising:

a carburetor center section defining a plurality of open-ended bores extending therethrough;

a venturi sleeve removably positioned in each of said bores, each said sleeve having an external surface sized and shaped to match the size and shape of said bores and an internal venturi throat having an annular wall constriction provided thereon for generating a zone of low pressure at the constriction in response to a flow of air moving through said throat, wherein each said venturi sleeve bears a color for visually identifying the sizes and shapes of the venturi throats with sleeves of the same size and shape bearing the same color;

a baseplate removably attached to said center section and having a plurality of openings extending therethrough, each opening being dimensioned to match the size and shape of a lower end of said venturi throats of said venturi sleeves, said baseplate bearing a color which corresponds to the color of said sleeves for visually identifying the dimensions of said openings provided in said baseplate; and a pair of fuel metering blocks removably attached to said center section and bearing a color which identifies the type of fuel to flow through the metering clock;

so that when venturi sleeves, a baseplate and a pair of metering blocks of corresponding colors are assembled on a common center section, their sizes, shapes and capacities will match each other.

11. The carburetor of claim 10, wherein said color for identifying the sizes and shapes of said venturi throats of said sleeves comprise a color of said venturi sleeve.

12. The carburetor of claim 10, wherein said color for identifying the dimensions of said openings of said baseplate is a color of said baseplate.

13. The carburetor of claim 10, wherein said color for identifying a metering capacity of said pair of metering blocks comprises a color of said metering blocks.

14. A carburetor for an internal combustion engine, comprising:

a carburetor center section defining a plurality of open-ended and substantially identically sized and shaped bores extending therethrough;

a venturi sleeve removably positioned in each of said bores, each venturi sleeve having an exterior surface being sized and shaped to match the size and shape of said carburetor bores and an interior surface defining an internal open-ended venturi throat for permitting the flow of air therethrough, said venturi throat having an annular wall constriction for generating a zone of low pressure at said wall constriction in response to air moving through said throat;

said venturi sleeves being selected from a supply of venturi sleeves consisting of:

groups of venturi sleeves, with said venturi sleeves of each group having substantially identically sized and shaped venturi throats, and the size and shape of said venturi throats of each group being different than the sizes and shapes of said venturi throats of other groups of venturi sleeves, and all of said venturi sleeves of each group of venturi sleeves being of the same color, and said venturi sleeves of each group being of different colors than said venturi sleeves of other groups, wherein visual inspection of said venturi sleeves in said bores of said carburetor center section reveals the color of said venturi sleeves and therefore indicates the size and shape of said venturi throats of the venturi sleeves in the carburetor center section.

15. A method for assembling carburetor components with corresponding sizes and shapes, said method comprising the steps of:

providing a carburetor center section defining a plurality of open-ended bores extending therethrough;

inserting a plurality of venturi sleeves in the bores, each sleeve having an internal venturi throat for passing air therethrough, wherein the size and shape of the venturi throats of the venturi sleeves are indicated by the color of the sleeves;

mounting a baseplate to the base of the center section and having a plurality of openings therein dimensioned to match the dimensions of a lower end of the venturi throats, wherein the size of the openings in the baseplate is indicated by the color of the baseplate and corresponds to the color of the sleeves; and providing a chart which conveys the correlation between the color of a component and the physical parameters of the component;

whereby upon inspecting the assembled carburetor and referencing the chart, one can determine the physical parameters of the colored components.

16. The method of claim 15, including further providing a pair of fuel metering blocks removably attachable to the center section, wherein the metering capacity of the blocks are indicated by the color of the blocks.

* * * * *